US009445195B2

(12) United States Patent
Gotoh et al.

(10) Patent No.: US 9,445,195 B2
(45) Date of Patent: Sep. 13, 2016

(54) DIRECTIVITY CONTROL METHOD AND DEVICE

(71) Applicant: KYOEI ENGINEERING CO., LTD., Agano-shi, Niigata (JP)

(72) Inventors: Akira Gotoh, Yokosuka (JP); Yoshitaka Murayama, Yashio (JP)

(73) Assignee: KYOEI ENGINEERING CO., LTD., Agano-Shi, Nigata (JP)

( * ) Notice: Subject to any disclaimer, the term of this patent is extended or adjusted under 35 U.S.C. 154(b) by 98 days.

(21) Appl. No.: 14/338,365

(22) Filed: Jul. 23, 2014

(65) Prior Publication Data

US 2014/0334639 A1 Nov. 13, 2014

Related U.S. Application Data

(63) Continuation of application No. PCT/JP2012/ 052442, filed on Jan. 27, 2012.

(51) Int. Cl.

| | |
|---|---|
| ***H04R 3/00*** | (2006.01) |
| ***G10L 21/0216*** | (2013.01) |
| ***H04R 1/40*** | (2006.01) |

(Continued)

(52) U.S. Cl.

CPC ..... *H04R 3/005* (2013.01); *G10L 2021/02166* (2013.01); *H04R 1/406* (2013.01); *H04R 5/027* (2013.01); *H04R 5/04* (2013.01); *H04R 2201/40* (2013.01); *H04R 2430/20* (2013.01); *H04R 2499/11* (2013.01); *H04S 2400/15* (2013.01)

(58) Field of Classification Search

None

See application file for complete search history.

(56) References Cited

U.S. PATENT DOCUMENTS

2011/0060433 A1* 3/2011 Dai ..... G06F 17/147 700/94

2011/0313763 A1 12/2011 Amada

FOREIGN PATENT DOCUMENTS

| | | | |
|---|---|---|---|
| JP | 2000305594 | A | 11/2000 |
| JP | 2001177900 | A | 6/2001 |
| JP | 2004289762 | A | 10/2004 |

(Continued)

OTHER PUBLICATIONS

Nikolajevic, V. and Fettweis, G., "Computation of Forward and Inverse MDCT Using Clenshaw's Reccurence Formula", May 2003, Signal Processing, IEEE Transactions on (vol. 51 , Issue: 5 ), pp. 1439-1444.*

(Continued)

*Primary Examiner* — Curtis Kuntz
*Assistant Examiner* — Kenny Truong
(74) *Attorney, Agent, or Firm* — Nath, Goldberg & Meyer; Jerald L. Meyer; Christopher Thomas

(57) ABSTRACT

Directivity control method and device which can emphasize or suppress sound deriving from an arbitrary direction with a little computation using two microphones closely disposed are provided. An interchange circuit 2 alternately interchanges a pair of input signals InL, InR for each one sample to generate a pair of interchanged signals InA, InB. A coefficient updating circuit 3 multiplies the one InB of the interchanged signals by a coefficient m to generate an error signal between the interchanged signals InA, InB. A recurrence formula of the coefficient m containing the error signal is calculated to update the coefficient m for each one sample. Subsequently, the pair of input signals InL, InR are multiplied by the sequentially updated coefficient m, and output.

14 Claims, 3 Drawing Sheets

(51) Int. Cl.
*H04R 5/027* (2006.01)
*H04R 5/04* (2006.01)

(56) References Cited

FOREIGN PATENT DOCUMENTS

| | | | |
|---|---|---|---|
| JP | 2009027388 | A | 2/2009 |
| JP | 2009135593 | A | 6/2009 |
| JP | 2009218663 | A | 9/2009 |
| JP | 2010263280 | A | 11/2010 |

OTHER PUBLICATIONS

Bouquin, et al., "Using the Coherence Function for Noise Reduction", IEE Proceedings-1, vol. 139, No. 3, pp. 276-280, Jun. 1992.
European Patent Application No. 12866703.7, Search Report dated Aug. 15, 2015, eight (8) pages.
Search Report issued in International Application No. PCT/JP2012/052442 mailed Apr. 3, 2012, two (2) pages.

* cited by examiner

DIRECTIVITY CONTROL METHOD AND DEVICE

CROSS-REFERENCE TO RELATED APPLICATIONS

This application is a Continuation of PCT Application No. PCT/JP2012/052442, filed on Jan. 27, 2012, the entire content of which is incorporated herein by reference.

TECHNICAL FIELD

The present disclosure relates to a sound collector device that collects sound with a directivity in an arbitrary direction while using two microphones closely disposed to each other.

BACKGROUND ART

In sound recording, in order to effectively collect target sound, it is necessary to suppress an inputting of surrounding sounds like noises. To collect sound in an arbitrary direction, target sound can be clearly collected using a directivity microphone. In addition, a realistic sensation can be realized through stereo recording with a wide pitch. In the case of IC recorders, a large number of methods which process input signals by two microphones, emphasize sound in an arbitrary direction, or suppress sounds in other directions to collect sound.

For example, according to the technology disclosed in Patent Document 1, it is determined whether or not input sound is in a target direction based on input signals by two microphones closely disposed, corrects a difference in the phase of the two input signals, and emphasizes sound in the target direction. In addition, according to the technology disclosed in Patent Document 2, two input signals are referred to each other, and filtering is sequentially performed using an obtained signal. When this technology is applied to signals input through two microphones, sound in the same phase can be extracted and emphasized. That is, it becomes possible to emphasize sound in a predetermined direction, and to add directivity.

SUMMARY OF INVENTION

Technical Problem

Meanwhile, in order to meet a demand to enable a casual recording in accordance with a situation, IC recorders are becoming compact. When an IC recorder is downsized to a portable size, two microphones provided for stereo recording are closely disposed to each other. In this case, since the distance between the two microphones is short, the phase difference at the time of sound collecting becomes extremely small. Hence, emphasis and suppression in accordance with the directivity direction and the positional relationship with a sound source, and sound collection with a sense of horizontal separation become difficult. This tendency is remarkable in the case of low-frequency wavelengths having a wavelength several ten times as much as the distance between the two microphones.

In addition, the technology disclosed in Patent Document 1 is based on an obtainment of a phase difference, and thus it is necessary to dispose microphones with equal to or greater than a certain pitch. Even if this technology is applicable to a low-frequency wavelength, multiple delay devices and a long filter coefficient are necessary, and the computing process becomes complex.

According to the technology disclosed in Patent Document 2, sufficient directivity can be added in the case of a stereo sound source, but when, like IC recorders, two microphones are closely disposed, the phase difference between respective input sounds becomes small, and this technology does not have a sensitivity that can obtain such a difference. In addition, the filter is sequentially updated based on a computation result, and thus the filter length becomes long and the load of the computing process increases.

The present disclosure has been made to address the problems of the aforementioned conventional technologies, and it is an objective to provide directivity control method and device which can emphasize or suppress, and output sound deriving from an arbitrary direction with a little computation using two microphones closely disposed to each other.

Solution to Problem

To accomplish the above objective, a directivity control method according to an embodiment is for applying an effectiveness to a pair of input signals input through a pair of microphones in accordance with a phase difference between the pair of input signals, and the method includes: a first step of alternately interchanging the pair of input signals for each one sample through an interchange circuit to generate a pair of interchanged signals; a second step of multiplying one of the interchanged signals by a coefficient m to generate an error signal between the interchanged signals; a third step of calculating a recurrence formula of the coefficient m containing the error signal to update the coefficient m for each one sample; and a fourth step of multiplying the pair of input signals by the sequentially updated coefficient m and outputting a result.

The second and third steps may: input one of the interchanged signals to a first integrator set with −1 time of a past coefficient m calculated one sample before; input, after through the first integrator, to a first adder adding the pair of interchanged signals; input, after through the first adder, to a second integrator set with a constant μ; input, after through the second integrator, to a third integrator set with the one of the interchanged signals before multiplied by the past coefficient m; and input, after through the third integrator, to a second adder set with the past coefficient m calculated one sample before, to update the coefficient m for each one sample.

The third step may: include a fifth step of multiplying a past coefficient m calculated one sample before by a constant β, and calculate the recurrence formula that refers to a multiplication result through the fifth step; and, sequentially attenuate an output signal through the third step when the constant β is smaller than 1 and the input signals of smaller than a certain level are successive.

The third step may: include a fifth step of multiplying a past coefficient m calculated one sample before by a constant β, and calculate the recurrence formula that refers to a multiplication result through the fifth step; and, emphasize effectiveness through the third step beyond the phase difference between the input signals when the constant β is smaller than 1.

The input signal may be subjected to a band division in advance, and each of the aforementioned steps may be performed for each band.

Advantageous Effects of Invention

According to the present disclosure, the number of calculations is remarkably reduced by an interchange circuit and one circuit that calculates a recurrence formula, while at the same time, sound signals deriving from the center position between the pair of microphones are precisely emphasized, and sound signals deriving from a direction having an angle shifted from the center position are precisely suppressed.

DESCRIPTION OF EMBODIMENTS

Embodiments of directivity control method and device according to the present disclosure will be explained in detail with reference to the drawings.

(Configuration)

Figure 1:
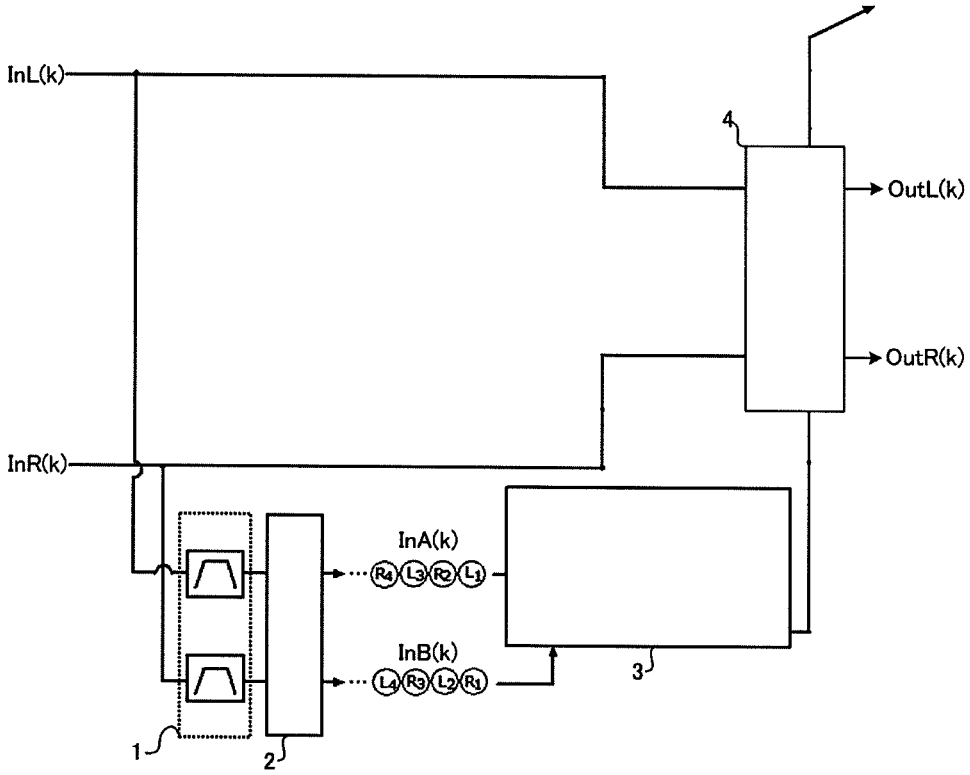
FIG. 1 is a block diagram illustrating a configuration of a directivity control device.

FIG. 1 is a block diagram illustrating a configuration of a directivity control device. The directivity control device is connected to a pair of microphones L, R with a predetermined distance therebetween, and as illustrated in FIG. 1, receives an input signal InL(k) and an input signal InR(k) from the microphones L, R.

The input signal InL(k) and the input signal InR(k) are discrete values having undergone sampling by an AD converter. That is, the input signal InL(k) is output by the microphone L, and is a digital signal having undergone sampling in a k-th order. The input signal InR(k) is output by the microphone R, and is a digital signal having undergone sampling in the k-th order.

The input signal InL(k) and the input signal InR(k) are input in an interchange circuit 2 through a characteristic correcting circuit 1 in the directivity control device. The characteristic correcting circuit 1 includes a frequency-characteristic correcting filter, and a phase-characteristic correcting circuit. The frequency-characteristic correcting filter extracts a sound signal in a desired frequency band. The phase-characteristic correcting circuit reduces an adverse effect to the input signal InL(k) and the input signal InR(k) by the acoustic characteristics of the microphones L, R.

The interchange circuit 2 alternately interchanges and outputs the input signal InL(k) and the input signal InR(k) for each one sample. That is, the data sequence of an interchanged signal InA(k) and that of an interchanged signal InB(k) become as follow when k=1, 2, 3, 4 . . . and the like.

InA(k)={InL(1) InR(2) InL(3) InR(4) . . . }

InB(k)={InR(1) InL(2) InR(3) InL(4) . . . }

The interchanged signal InA(k) and the interchanged signal InB(k) are input to a coefficient updating circuit 3. This coefficient updating circuit 3 calculates an error between the interchanged signal InA(k) and the interchanged signal InB(k), and decides a coefficient m(k) in accordance with the error. In addition, the coefficient updating circuit 3 sequentially updates the coefficient m(k) with reference to a past coefficient m(k−1).

An error signal e(k) between the interchanged signal InA(k) an the interchanged signal InB(k) reaching simultaneously will be defined as a following formula (1).

$$e(k)=\mathrm{In}B(k)-m(k-1)\times\mathrm{In}A(k) \tag{1}$$

This coefficient updating circuit 3 takes the error signal e(k) as a function of the coefficient m(k−1), and calculates an adjoining-two-terms recurrence formula of the coefficient m(k) containing the error signal e(k), thereby searching the coefficient m(k) that minimizes the error signal e(k). The coefficient updating circuit 3 updates the coefficient through this computing process in such a way that the more a phase difference is caused between the input signal InL(k) and the input signal InR(k), the more the coefficient m(k) decreases, and when both signals are in the same phase, the coefficient m(k) is made close to 1, and is output.

The coefficient m(k) is input to a synthesizing circuit 4. The synthesizing circuit 4 multiplies the input signal InL(k) and the input signal InR(k) by the coefficient m(k), respectively, at a predetermined ratio, adds results at a predetermined ratio, and outputs, as a result, an output signal OutL(k) and an output signal OutR(k).

Figure 2:
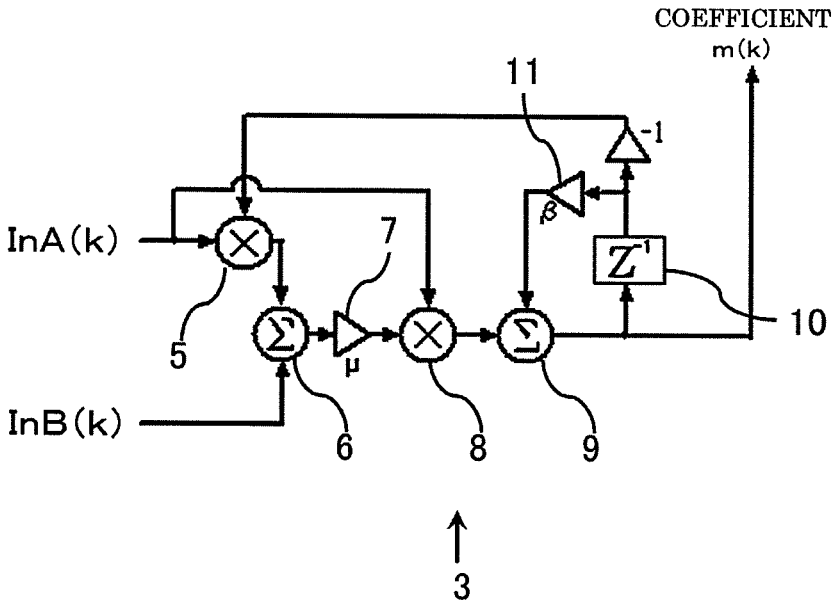
FIG. 2 is a block diagram illustrating an example coefficient updating circuit.

FIG. 2 is a block diagram illustrating an example coefficient updating circuit 3. As illustrated in FIG. 2, the coefficient updating circuit 3 includes multiple integrators and adders, is a circuit realizing an adjoining-two-terms recurrence formula, and sequentially updates the coefficient m(k) with reference to a past coefficient m(k−1). An adaptive filter having a long tap number is eliminated.

This coefficient updating circuit 3 generates the error signal e(k) using the interchanged signal InB(k) as a reference signal. That is, the interchanged signal InA(k) is input to an integrator 5. The integrator 5 multiplies the interchanged signal InA(k) by −1 of the coefficient m(k−1) one sample before. An adder 6 is connected to the output side of the integrator 5. The signal output by the integrator 5 and the interchanged signal InB(k) are input to this adder 6, and those signals are added together to obtain an instant error signal e(k). The error signal e(k) through this computing process can be expressed as the following formula (2)

$$e(k)=-m(k-1)\times\mathrm{In}A(k)+\mathrm{In}B(k) \tag{2}$$

The error signal e(k) is input to an integrator 7 that multiplies an input signal by μ. The coefficient μ is a step-size parameter smaller than 1. An integrator 8 is connected to the output side of the integrator 7. The interchanged signal InA(k) and a signal μe(k) through the integrator are input to this integrator 8. This integrator 8 multiplies the interchanged signal InA(k) by the signal μe(k), and obtains a differential signal $\partial E(m)^2/\partial m$ that is an instant square error expressed as the following formula (3).

$$\partial E(m)^2/\partial m=\mu\times e(k)\times\mathrm{In}A(k) \tag{3}$$

The integrator 8 is connected with an adder 9. The adder 9 computes the following formula (4) to finish the coefficient m(k), and sets the coefficient m(k) to the synthesizing circuit 4 that generates the output signals OutL(k) and OutInR(k) from the input signals InL(k) and InR(k).

$$m(k)=m(k-1)\times\beta+\partial E(m)^2/\partial m \tag{4}$$

That is, the adder 9 adds a signal β·m(k−1) to the differential signal $\partial E(m)^2/\partial m$ to finish the coefficient m(k).

As to the signal β·m(k−1), a delay device 10 that delays a signal by one sample, and an integrator 11 that integrates the constant β are connected to the output side of the adder 9, and the integrator 11 multiplies the coefficient m(k−1) updated by a signal processing one sample before by the constant β to generate the signal β·m(k−1).

Hence, the coefficient updating circuit 3 realizes a computing process expressed by the following recurrence formula (5), the coefficient m(k) is generated and is sequentially updated for each one sample.

$$m(k)=m(k-1)\times\beta+(-m(k-1)\times \mathrm{In}A(k)+\mathrm{In}B(k))\times\mu\times \mathrm{In}A(k) \quad (5)$$

(Action)

As explained above, according to the directivity control device, when the input signal InL(k) and the input signal InR(k) are input, the output signal OutL(k) and the output signal OutInR(k) expressed as the following formulae (6) and (7) are generated and output.

$$\mathrm{Out}L(k)=m(k)\times \mathrm{In}L(k) \quad (6)$$

$$\mathrm{Out}R(k)=m(k)\times \mathrm{In}R(k) \quad (7)$$

Figure 3:
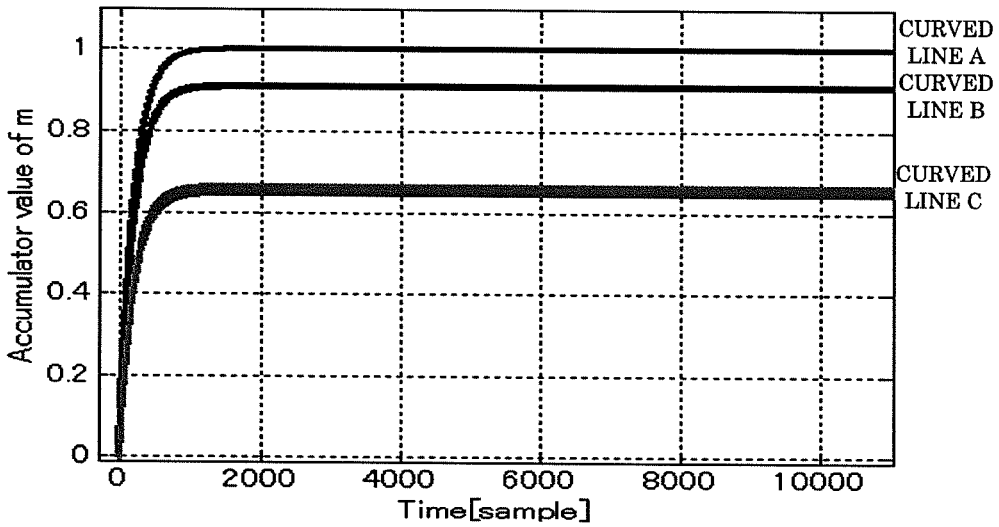
FIG. 3 is a graph illustrating an example convergence of a coefficient m(k)

FIG. 3 illustrates an example convergence of the coefficient m(k). FIG. 3 illustrates how the coefficient m(k) converges when the coefficient m(0) is set as an origin in advance with the horizontal axis being a sampling number, and the vertical axis being as the coefficient m(k). It is presumed that the pitch between the microphones L, R is 25 mm. The input signal InL(k) and the input signal InR(k) have a frequency of 1000 Hz, and have a phase difference of 0 (curved line A), 10.00 degrees (curved line B), and 26.47 degrees (curved line C). Note that the constant β is 1.000.

As illustrated in FIG. 3, when the phase difference is 0, the coefficient m(k) converges toward 1. Conversely, when the phase difference is 10.00 degrees, the coefficient m(k) converges toward 0.91, and when the phase difference is 26.47 degrees, the coefficient m(k) converges toward 0.66.

As explained above, it becomes clear that the output signal OutL(k) and the signal OutInR(k) are emphasized or suppressed by the coefficient m(k) in accordance with the phase difference through the directivity control device. In other words, the closer the sound source is to the center position between the microphones L, R, the more the input signal InL(k) and the input signal InR(k) are emphasized. Conversely, the more the sound source is distant from the center position of the microphones L, R, the more the input signal InL(k) and the input signal InR(k) are suppressed. The center position is a position present on a perpendicular line to a line interconnecting the microphones L, R and passing through the midpoint thereof.

Figure 4:
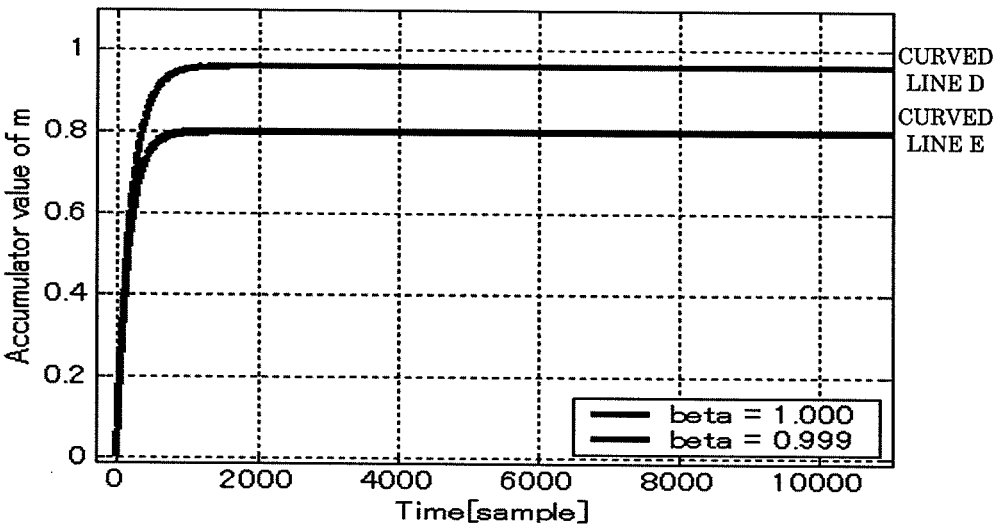
FIG. 4 is a graph illustrating how the coefficient m(k) converges when a constant β is changed.

In addition, FIG. 4 illustrates how the coefficient m(k) converges when the constant β is changed. FIG. 4 illustrates a case (curved line D) in which the coefficient m(k) is obtained when β=1.000 and a case (curved line E) in which the coefficient m(k) is obtained when β=0.999. As illustrated in FIG. 4, when β=1.000 for a signal having a phase difference of 26.47 degrees, the coefficient m(k) converges toward 0.96, but when β=0.999, the coefficient m(k) converges toward 0.8.

As explained above, when the coefficient β is set to be less than 1, the coefficient m(k) can have effectiveness equal to or larger than the phase difference between the input signal InL(k) and the input signal InR(k). For example, the input signal InL(k) and the input signal InR(k) having a longer wavelength than the adjoining distance between the microphones L, R have a small phase difference. However, by changing the coefficient β, such sound can be clearly emphasized or suppressed by the coefficient m(k).

Next, an explanation will be given of the purpose of the interchange circuit. The coefficient updating circuit alternately calculates the following formula (8) through the interchange circuit.

When k is an odd number:

$$m(k)=m(k-1)\times\beta+(-m(k-1)\times \mathrm{In}L(k)^2+\mathrm{In}L(k)\times \mathrm{In}R(k))\times\mu$$

When k is an even number:

$$m(k)=m(k-1)\times\beta+(-m(k-1)\times \mathrm{In}R(k)^2+\mathrm{In}R(k)\times \mathrm{In}L(k))\times\mu \quad (8)$$

In the formula (8), the square term of the signal acts to reduce the decorrelation component like white noises as time advances. Conversely, the adjoining term is equivalent to the numerator of the following formula (9) to sequentially calculate a correlation coefficient, and the effect of the correlation component is reflected on the coefficient m.

$$R(n) = R(n-1)\times\partial+\frac{x\times y}{|x||y|}(1-\partial) \quad (9)$$

That is, when the coefficient updating circuit approximates the input signal InR(k) to the input signal InL(k), the decorrelation component of the input signal InL(k) is amplified, but the decorrelation component of the input signal InR(k) is suppressed. In addition, when the input signal InL(k) is approximated to the input signal InR(k), the decorrelation component of the input signal InR(k) is amplified, while the decorrelation component of the input signal InL(k) is suppressed.

Hence, when the interchange circuit 2 is placed prior to the coefficient updating circuit 3, an action of approximating the input signal InR(k) to the input signal InL(k), and synthesizing and adding those together, and an action of approximating the input signal InL(k) to the input signal InR(k), and synthesizing and adding those together are alternately repeated. Hence, actions of amplifying and suppressing the decorrelation component are mutually canceled, and the effect of the correlation component is deeply reflected on the coefficient m(k).

Figure 5:
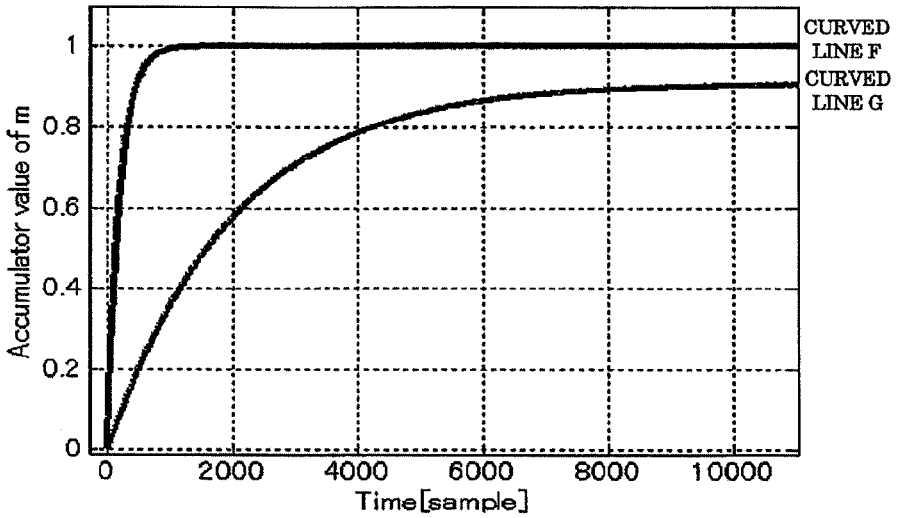
FIG. 5 is a graph illustrating a convergence speed of the coefficient m(k) in accordance with a presence/absence of an interchange circuit.

FIG. 5 illustrates how the coefficient m(k) converges when the interchange circuit 2 is present or when the interchange circuit is absent. Both converging conditions reflect a case in which the sound source is placed at the center position, and sounds are collected by the microphones L, R. As is indicated by a curved line F in FIG. 5, when the interchange circuit 2 is present, the coefficient m(k) converges to 1 at substantially 1000th time, but as is indicated by a curved line G, when there is no interchange circuit 2, the coefficient m(k) does not converge to 1 yet even if the coefficient is updated 10000 times, and thus the difference is 10 times. That is, it is indicated that when the interchange circuit 2 is present, the directivity control is promptly completed.

(Advantageous Effect)

As explained above, according to the directivity control device of this embodiment, the pair of input signals input to the microphones L, R are alternately interchanged by the interchange circuit for each one sample, and a pair of interchanged signals are generated. Next, the one interchanged signal is multiplied by the coefficient m to generate the error signal between the interchanged signals. Subsequently, the recurrence formula of the coefficient m containing the error signal is calculated to update the coefficient m for each one sample. Eventually, the sequentially updated coefficient m is multiplied to the pair of input signals to output the output signals.

According to this control method, for example, the one interchange signal is input to a first integrator set with −1 time of the past coefficient m calculated one sample before, input to a first adder that adds the pair of interchanged signals after through the first integrator, input to a second integrator set with a constant μ after through the first adder, input to a third integrator set with the one interchanged signal before the past coefficient m is multiplied after through the second integrator, and input to a second adder set with the past coefficient m calculated one sample before after through the third integrator, and then the coefficient m can be updated for each one sample.

Accordingly, sound signals derived from the center position between the microphones L, R are emphasized, while sound signals derived from direction having an angle shifted from the center position are suppressed. Therefore, a third microphone is realized which has a center of directivity at the center position, and which covers the directivity range of the microphones L, R. In addition, the way of emphasizing/suppressing the sound can be realized by an interchange circuit and one coefficient updating circuit that calculates the recurrence formula regardless of a filter, etc., having a large tap number. Accordingly, the number of calculations can be remarkably reduced, and the delay can be suppressed to within several ten microseconds to several milliseconds.

Still further, the constant β may be multiplied to the past coefficient m calculated one sample before, and a recurrence formula that refers to the multiplication result may be calculated. In this case, if the constant β is set to be less than 1, when input signals smaller than a certain level are successive, the output signals sequentially attenuate.

That is, when the constant β is set to be less than 1, a fade-out function of sequentially attenuating the coefficient m is realized. Hence, when sound reaching from an arbitrary direction again after a silent condition is collected, the value of the coefficient m(k) once converges to 0, and is updated. Accordingly, emphasis or suppression is performed appropriately. Therefore, even if sound generation from one sound source ends but new sound is generated from another sound source, in generation of the coefficient m to the new sound generation, the sound generation by the previous sound source does not affect the current sound collection.

In addition, when the constant β is set to be less than 1, the effectiveness of the output signal is emphasized beyond the phase difference of the input signals. The value of the constant β can be set for each band when the input signal is subjected to a band division in advance, and each of the above-explained steps is performed for each band. Hence, a parallel process of obtaining the coefficient m(k) for each band is enabled, while at the same time, the constraint condition inherent to a wide-band signal is canceled. Therefore, an appropriate emphasis or suppression in accordance with the band is enabled.

Other Embodiments

The embodiment of the present disclosure was explained above, but the embodiment is merely presented as an example, and is not intended to limit the scope and spirit of the present disclosure. Such a novel embodiment can be carried out in various forms, and permits various omissions, replacements, and modifications without departing from the scope and spirit of the present disclosure. The embodiment and the modified examples thereof are within the scope and spirit of the present disclosure, and within the scope of the subject matter as recited in the appended claims and within the equivalent range thereto.

Figure 6:
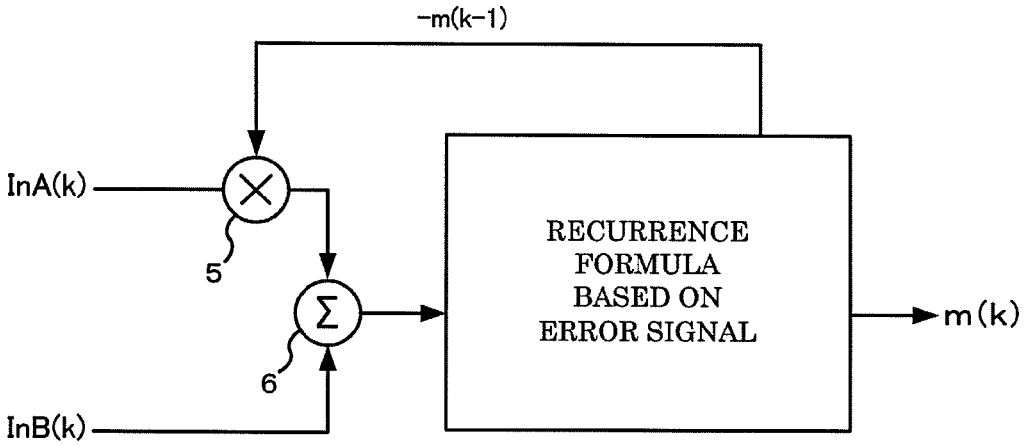
FIG. 6 is a block diagram illustrating a configuration of a directivity control device according to another embodiment.

For example, as illustrated in FIG. 6, when one of the interchanged signals is multiplied by the coefficient m to generate an error signal of the interchanged signals, a recurrence formula of the coefficient m containing this error signal is calculated and the coefficient m is updated for each one sample, the coefficient updating circuit is not limited to the above-explained embodiment, but can be realized in other forms.

In addition, this directivity control device can be realized as the software process through a CPU or a DSP, or, may be realized by an exclusive digital circuit.

The invention claimed is:

1. A directivity control method for controlling a directivity of a pair of microphones, the method comprising:

a step of detecting a ratio of a pair of input signals input from the pair of microphones in accordance with a shifted amount in a direction of a sound source relative to a center of the pair of microphones; and a step of giving a directivity to emphasize or suppress the pair of input signals in accordance with the shifted amount of the sound source of the pair of input signals in the direction relative to the center of the pair of microphones by reflecting the ratio on the pair of input signals, wherein:

in the detecting step, a coefficient m converging to the ratio is generated by causing both of the pair of input signals to be alternately approximated to each another, the detecting step comprises:

a first step of alternately interchanging the pair of input signals for each one sample through an interchange circuit to generate a pair of interchanged signals;

a second step of multiplying one of the interchanged signals by the coefficient m to generate an error signal between the one interchanged signal to which the coefficient m is multiplied and the other interchanged signal; and a third step of calculating a recurrence formula of the coefficient m containing the error signal to update the coefficient m for each one sample, and the directivity giving step comprises a fourth step of multiplying the pair of input signals by the sequentially updated coefficient m and outputting a result.

2. The directivity control method according to claim 1, wherein the third step:

comprises a fifth step of multiplying a past coefficient m calculated one sample before by a constant β, and calculates the recurrence formula that refers to a multiplication result through the fifth step; and sequentially attenuates an output signal through the third step when the constant β is smaller than 1 and the input signals of smaller than a certain level are successive.

3. The directivity control method according to claim 1, wherein the third step:

comprises a fifth step of multiplying a past coefficient m calculated one sample before by a constant β, and calculates the recurrence formula that refers to a multiplication result through the fifth step; and emphasizes the pair of input signals through the third step beyond a phase difference between the input signals when the constant β is smaller than 1.

4. The directivity control method according to claim 1, wherein the second and third steps, to update the coefficient m for each one sample:

input one of the interchanged signals to a first integrator set with −1 time of a past coefficient m calculated one sample before;

input, after through the first integrator, to a first adder adding the pair of interchanged signals;

input, after through the first adder, to a second integrator set with a constant μ;

input, after through the second integrator, to a third integrator set with the one of the interchanged signals before multiplied by the past coefficient m; and input, after through the third integrator, to a second adder set with the past coefficient m calculated one sample before.

5. The directivity control method according to claim 4, wherein in the third step:

a fourth integrator multiplying the past coefficient m calculated one sample before by a constant β is provided, and the second adder is set with the past coefficient m after through the fourth integrator; and the pair of input signals is emphasized through the third step beyond a ratio of instantaneous values of the input signals when the constant β is smaller than 1.

6. The directivity control method according to claim 4, wherein in the third step:

a fourth integrator multiplying the past coefficient m calculated one sample before by a constant β is provided, and the second adder is set with the past coefficient m after through the fourth integrator; and the pair of input signals is emphasized through the third step beyond the phase difference between the input signals when the constant β is smaller than 1.

7. The directivity control method according to claim 1, wherein the input signal is subjected to a band division in advance, and each of the steps are performed for each band.

8. A directivity control device for controlling a directivity of a pair of microphones, the device comprising:

wherein the directivity control device detects a ratio of a pair of input signals input from the pair of microphones in accordance with a shifted amount in a direction of a sound source relative to a center of the pair of microphones;

wherein the directivity control device gives a directivity to emphasize or suppress the pair of input signals in accordance with the shifted amount of the sound source of the pair of input signals in the direction relative to the center of the pair of microphones by reflecting the ratio on the pair of input signals, wherein a coefficient m converging to the ratio is generated by causing both of the pair of input signals to be alternately approximated to each another, the directivity control device comprising:

an interchanger alternately interchanging the pair of input signals for each one sample to generate a pair of interchanged signals;

an error signal generator multiplying one of the interchanged signals by a coefficient m to generate an error signal between the interchanged signals;

a recurrence formula calculator calculating a recurrence formula of the coefficient m containing the error signal to update the coefficient m for each one sample; and an integrator multiplying the pair of input signals by the sequentially updated coefficient m and outputting a result.

9. The directivity control device according to claim 8, wherein the recurrence formula calculator:

comprises a muting unit multiplying a past coefficient m calculated one sample before by a constant β, and calculates the recurrence formula with reference to a multiplication result by the muting unit; and sequentially attenuates an output signal through the recurrence formula calculator when the constant β is smaller than 1 and the input signals of smaller than a certain level are successive.

10. The directivity control device according to claim 8, wherein the recurrence formula calculator:

comprises an emphasizing processor multiplying a past coefficient m calculated one sample before by a constant β, and calculates the recurrence formula with reference to a multiplication result by the emphasizing processor; and applies, to an output signal through the recurrence formula calculator, emphasis on the pair of input signals beyond a phase difference between the input signals when the constant β is smaller than 1.

11. The directivity control device according to claim 8, wherein:

the error signal generator comprises:

a first integrator set with −1 time of a past coefficient m calculated one sample before, and through which one of the interchanged signals passes; and a first adder adding the pair of interchanged signals after through the first integrator, the recurrence formula calculator comprises:

a second integrator set with a constant μ, and through which a signal through the first adder passes;

a third integrator set with the one of the interchanged signals before multiplied by the past coefficient m, and through which a signal through the second integrator passes; and a second adder set with the past coefficient m calculated one sample before, and through which a signal through the third integrator passes, and the coefficient m is updated for each one sample.

12. The directivity control device according to claim 11, wherein:

the recurrence formula calculator further comprises a fourth integrator multiplying the past coefficient m calculated one sample before by a constant β;

the second adder is set with the past coefficient m after through the fourth integrator; and the pair of input signals is emphasized through the recurrence formula calculator beyond the instantaneous values between the input signals when the constant β is smaller than 1.

13. The directivity control device according to claim 11, wherein:

the recurrence formula calculator further comprises a fourth integrator multiplying the past coefficient m calculated one sample before by a constant β;

the second adder is set with the past coefficient m after through the fourth integrator; and the pair of input signals is emphasized through the recurrence formula calculator beyond the phase difference between the input signals when the constant β is smaller than 1.

14. The directivity control device according to claim 8, further comprising a divider that performs band division on the input signal in advance, wherein generation of the interchanged signals, generation of the error signal, updating of the coefficient m, and multiplication and outputting of the pair of input signal by the coefficient m are performed for each band.

* * * * *